US007086129B2

(12) United States Patent
Kissels et al.

(10) Patent No.: US 7,086,129 B2
(45) Date of Patent: Aug. 8, 2006

(54) SYSTEM FOR PRODUCING WOUND WARPS

(75) Inventors: Heinz Kissels, Wegberg (DE); Elmar Lennartz, Schwalmtal (DE)

(73) Assignee: Moenus Textilmaschinen GmbH, Gera (DE)

( * ) Notice: Subject to any disclaimer, the term of this patent is extended or adjusted under 35 U.S.C. 154(b) by 0 days.

(21) Appl. No.: 11/260,874

(22) Filed: Oct. 27, 2005

(65) Prior Publication Data

US 2006/0090316 A1 May 4, 2006

(30) Foreign Application Priority Data

Oct. 30, 2004 (DE) ..... 10 2004 052 735

(51) Int. Cl.
*D02H 7/00* (2006.01)

(52) U.S. Cl. ..... 28/185; 28/196

(58) Field of Classification Search ..... 28/185, 28/196, 190, 191–195, 186, 187, 189; 33/738, 33/739, 732–735, 747, 750, 754, 746–748; 242/413.1, 413.2, 413.5

See application file for complete search history.

(56) References Cited

U.S. PATENT DOCUMENTS

| | | | | | |
|---|---|---|---|---|---|
| 2,382,760 | A | * | 8/1945 | Wiggermann | 28/196 |
| 2,691,809 | A | * | 10/1954 | Bauer et al. | 28/196 |
| 2,834,091 | A | * | 5/1958 | Furst | 28/196 |
| 2,972,796 | A | * | 2/1961 | Block | 28/195 |
| 3,063,123 | A | * | 11/1962 | Noe | 28/196 |
| 4,141,120 | A | * | 2/1979 | Schenk | 28/185 |
| 4,528,631 | A | * | 7/1985 | Bogucki-Land | 700/130 |
| 4,966,333 | A | * | 10/1990 | Bosch | 242/412.3 |
| 5,027,484 | A | * | 7/1991 | Baba | 28/185 |
| 5,257,462 | A | | 11/1993 | Buttermann | |
| 5,410,786 | A | * | 5/1995 | Bogucki-Land | 28/191 |
| 5,775,622 | A | * | 7/1998 | Jurgens et al. | 242/413.5 |
| 6,195,856 | B1 | * | 3/2001 | Kremer | 28/185 |

FOREIGN PATENT DOCUMENTS

| | | |
|---|---|---|
| DE | 32 06 272 | 9/1983 |
| DE | 36 04 790 | 8/1987 |
| EP | 1 219 738 | 7/2002 |

* cited by examiner

*Primary Examiner*—Amy B. Vanatta
(74) *Attorney, Agent, or Firm*—Andrew Wilford

(57) ABSTRACT

Wound warps are made by pulling a multiplicity of warp filaments off respective supplies and winding them around a warp beam by rotating the warp beam while pressing the filaments against the beam with a predetermined packing force by a packing roller. The packing roller is deflected outward from the beam by the filaments as same are wound on the beam, and an output is produced representing the rotation of the beam. Another output is derived from this outward deflection of the packing roller that represents the rectified length of the filaments wound on the beam. The outputs from a first wound warp are used as set points, and the outputs from a subsequent wound warp are used as actual values and compared to the set points. The force of the packing roller is varied such that the actual values of the subsequent wound warp are made generally equal to the set points.

10 Claims, 5 Drawing Sheets

SYSTEM FOR PRODUCING WOUND WARPS

FIELD OF THE INVENTION

The present invention relates to a warping system, that is a system for winding a multiplicity of parallel warp filaments, e.g. threads or yarns, onto an elongated warp beam. More particularly this invention concerns a method of and apparatus for producing a plurality of wound warps with filaments of identical length and diameter.

BACKGROUND OF THE INVENTION

In a weaving mill it is necessary to have or produce for the looms warp beams where all the warp threads or yarns are of identical length from one beam to the next. It is also important that all the beams of a given production run have the same diameter, the result being that the filament density is the same on all the beams. Thus it is in general known to monitor the length wound on the beam and the number of revolutions the beam made to wind up this length for a first model wound warp, and then to use these values as set points comparable to actual values determined during the winding of subsequent beams.

In German 32 06 272 of Koslowski the number of beam revolutions and the length of wound filament is continuously monitored, with respective set-point outputs produced and recorded for the model wound warp, that is the first of a series of wound warps that are supposed to be identical. The actual values of the number of beam revolutions and the length being wound in subsequent cycles for copies are compared to the respective set points and correction are made by changing the warp-beam rotation rate, acting on thread brakes in a filament-supply creel, or braking a packing roll so bring the actual values back to the respective set points. The filament length is determined simply by passing the entire warp sheet over a measuring roller coupled to rotation-detecting and -measuring sensor.

Another such system shown in EP 1,219,738 of Hane the beam rotation and the warp length are monitored to determine how much warp is wound up with each revolution of the beam, and this value is stored. The same values for copies are compared with the stored values to generate a difference signal. The tension in the warp is varied to keep the actual-value signals identical or close to the set-point signals, that is to reduce the respective difference signals to the smallest possible levels. When the warp filaments are elastic so that they can stretch, this is a problem. The actual-value of the filament length being wound is determined by passing the incoming warp sheet over a measuring roller, or by pressing a measuring roller against the wound warp on the warp beam.

There are substantial problems with these systems at the start and end of each winding cycle, that is the winding of a single copy beam. Excessive braking of a rotating beam can produce so much slack as to make the wound warp unusable, and excessive acceleration can tension the filaments enough to break or stretch them.

Accordingly, German 36 04 790 of Guillot describes a system where the density of the copies is controlled by varying the radial pressure exerted on the warp being wound by a packing roller. The actual value for the filament length is determined by a separate measuring roller also radially engaging the warp being wound. With this system the diameter of the warp being wound is used to determine the filament length for a given rotation of the beam, producing a partial length that is stored and compared with that of subsequent copies, with the packing roller pressure varied to produce uniformity. Such a system therefore has both a packing roller and a length-measuring roller.

In U.S. Pat. No. 5,257,462 of Butterman the warping system has a packing roller bearing upon the warp being wound and mechanically connected with a displacement detecting transducer that emits measurement impulses, a beam-driven shaft encoder that emits a predetermined number of calculation impulses for each revolution of the beam, and a computer that calculates the partial lengths of the warp layers or laps from the measurement impulses and the calculation impulses. The displacement-detecting transducer is movably or slidingly interengaged with an elongated linear member in the form of a toothed rack hinged so that a projection of one end always intersects the longitudinal axis of the lap beam. A correction read-out is calculated from the diameter of the axle of the lap beam and the position of the point of interengagement of the elongated linear member with the displacement detecting transducer through the pressure point of the packing roller bearing upon material wound upon the lap beam and the number of rotations of the lap beam. Such a system can calculate the total filament length and the wound density, but is quite complex.

OBJECTS OF THE INVENTION

It is therefore an object of the present invention to provide an improved system for producing multiple identical wound warps.

Another object is the provision of such an improved system for producing multiple identical wound warps that overcomes the above-given disadvantages, in particular that is fairly simple, that is particularly safe during the starting and ending stages of a winding operation, and that can produce a series of wound warps that are of identical length and density.

SUMMARY OF THE INVENTION

According to the invention wound warps are made by pulling a multiplicity of warp filaments off respective supplies and winding them around a warp beam by rotating the warp beam while pressing the filaments against the beam with a predetermined packing force by a packing roller. The packing roller is deflected outward from the beam by the filaments as same are wound on the beam, and an output is produced representing the rotation of the beam. Another output is derived according to the invention from this outward deflection of the packing roller that represents the rectified length of the filaments wound on the beam. The outputs from a first wound warp are used as set points, and the outputs from a subsequent wound warp are used as actual values and compared to the set points. The force of the packing roller is varied such that the actual values of the subsequent wound warp are made generally equal to the set points.

With the inventive system the outward deflection of the packing roller is used to determine the rectified length of the filaments wound on the warps, eliminating the need for a separate roller assembly bearing radially against the warp being wound and provided with its transducer. This represents a substantial simplification of the apparatus, and produces a plurality of wound warp beams of identical density, diameter, and filament length.

In accordance with the invention the density of the wound warp is directly determined by the outward deflection of the packing roller. This means of determining the filament length is more accurate than simply counting revolutions of a measuring roller bearing radially on the warp being wound or over which the warp passes between the beam and the supplies where slip is inevitable. Determining the filament length from the deflection of the packing roller is extremely accurate. This is due to the fact that the deflection of the packing roller closely corresponds exactly to the actual radius of the warp being wound more accurately, as a result of the packing force, than a simple sensor roller riding on the warp.

According to the invention outward deflection of the packing roller is braked to vary the force exerted by the packing roller on the warp being wound. Such braking allows the packing force to be set very accurately, simply by applying the brake more forcibly to increase the packing force and vice versa.

When the supplies are new the packing force is increased according to the invention by a predetermined compensating force, typically between 5% and 50% (preferably 10% to 30%) of the normal packing force. Without this step, it is necessary to provide separate means for controlling warp-filament tension, as otherwise the filament tension increases as the spools or packages from which they are drawn get smaller. With the system of the invention the extra packing force applied at the start, when the tension is inherently low, is compensated out. This inventive step is important when using new spools for producing a plurality of wound warps, where the starting pressure is the actual packing pressure is used. It is particularly advantageous at the start of a winding operation when the starting packing pressure is standardized, that is corresponds to the packing pressure used in an operation with a constant packing pressure and or average to light thread tension. In this manner it is not necessary to provide the creel, that is the yarn supply, with complex thread brakes to achieve the desired tension and density.

In accordance with the invention the packing force is adjusted during winding of subsequent warps by using interpolated set points. The control device, when of the SPS type, typically has limited memory. Using interpolated set points makes the regulation particularly sensitive and creates wound warps of particularly uniform density.

The packing roller according to the invention is mounted on one or two arms pivotal about an axis offset from the warp-beam axis. The packing-roller displacement is therefore along an arcuate path and is detected by a sensor assembly comprising a rod projecting past the packing roller and a position sensor carried on the roller, riding on the rod, and responsive to a position of the roller along the rod. The sensor can be a simple rotary unit having a pinion meshing with teeth formed on the edge of the rod, as in above-cited U.S. Pat. No. 5,257,462. This toothed rod is pivoted at one end.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
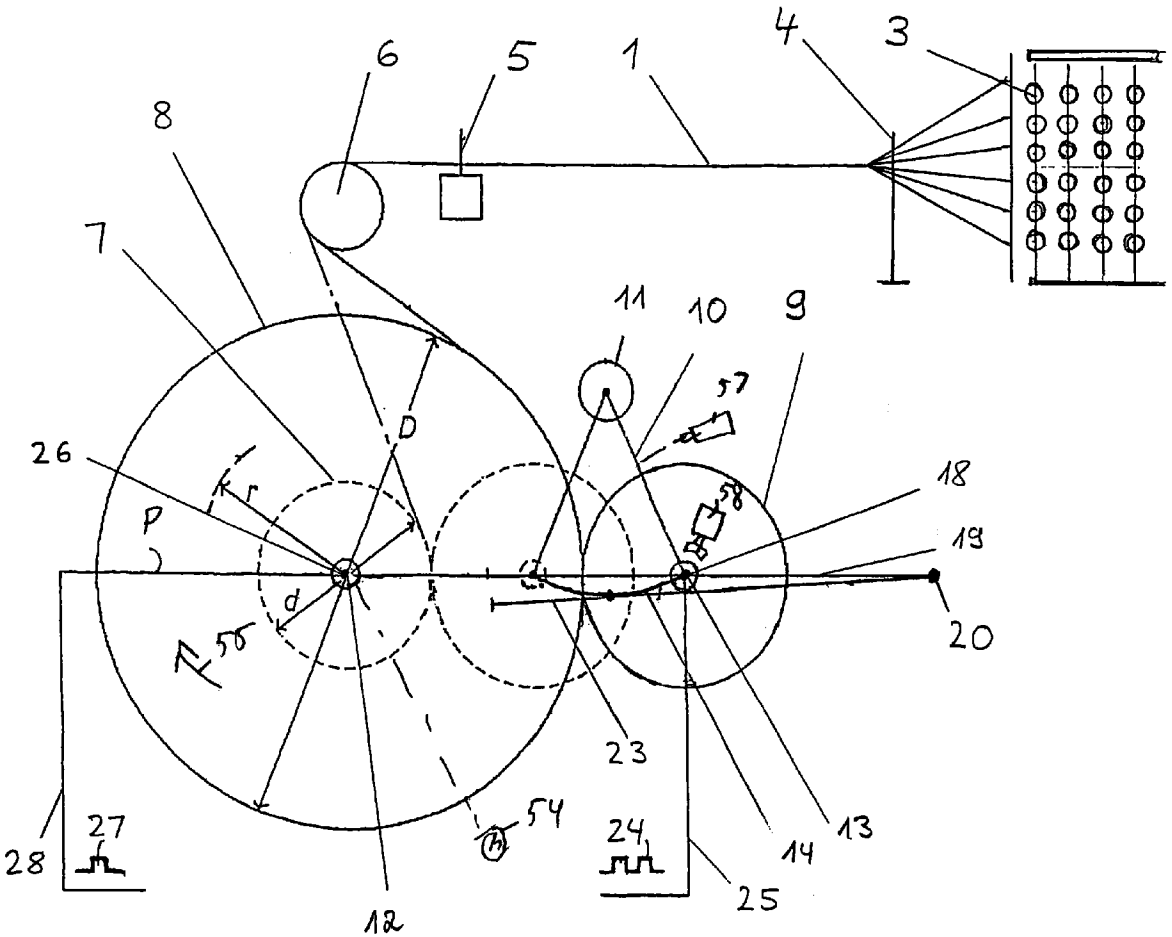
FIG. 1 is a largely schematic end view of the warping system of this invention.

As seen in FIG. 1 a warp 1 comprised of a multiplicity or sheet of parallel and coplanar filaments is pulled through an upstream guide 4 from a creel 3 holding a multiplicity of supply bobbins or packages with respective filament brakes and is passed through a standard guide comb 5 and over a deflecting roller 6 to tangentially wind up on a warp beam 7. A drive illustrated schematically at 54 rotates the beam 7 about its axis 12 in a direction 55. The beam 7 is cylindrical, has an outside diameter d, and is provided on its ends with flanges or plates 8 of circular shape extending perpendicular to the axis 12 and having an outside diameter D substantially greater than the diameter d. Ends of the beam 7 are supported in upright end plates 15 and 16 (FIG. 3) of a machine frame 17 (FIGS. 2 and 4).

The warp 1 is wound up on the beam 7 to a radius r which can be as small as d/2 and as large as D/2. The path of the warp 1 is shown in a dot-dash line for a radius r=d/2 and in solid lines for a radius r=D/2. The goal of the present invention is to form a first so-called model beam and then, in subsequent cycles, produce copies that are substantially identical.

To this end a packing or compacting roller 9 of cylindrical shape and centered on an axis 13 parallel to the axis 12 is carried on the outer ends of a pair of parallel arms 10 (see also FIG. 3) whose inner ends are mounted in the plates 15 and 16 for pivoting about an axis 11 parallel to the axes 12 and 13. Thus, as the roller 9 is pushed outward from an innermost position shown in dashed lines in which r=d/2 to an outer position shown in a solid line in which r=D/2, the axis 13 of the roller 9 moves through an arc 14 here shown to have a starting point on a plane P extending through the axis 12 and through the axis 13 in its outermost position.

Figure 2:
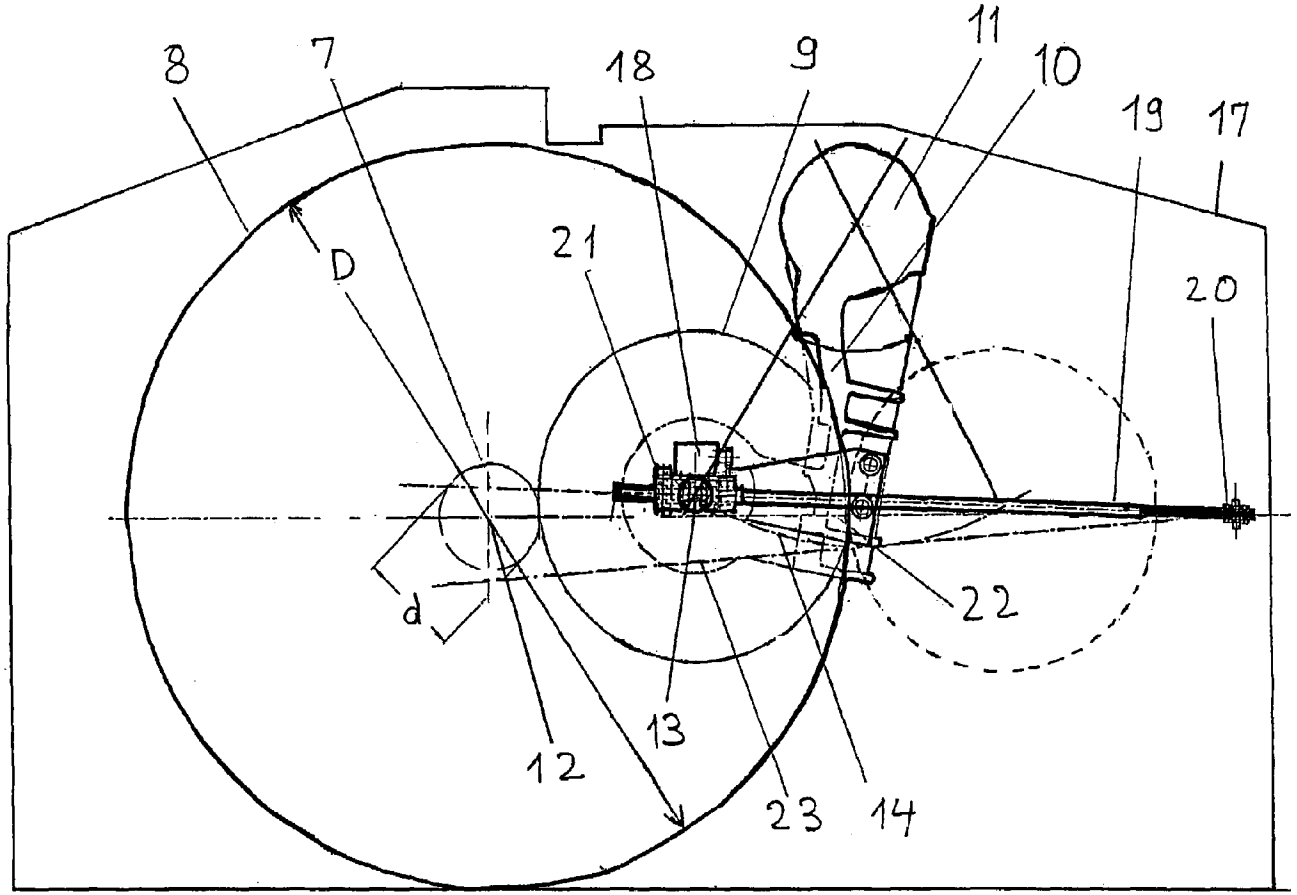
FIG. 2 is a larger-scale end view of a detail of the warping system.
Figure 3:
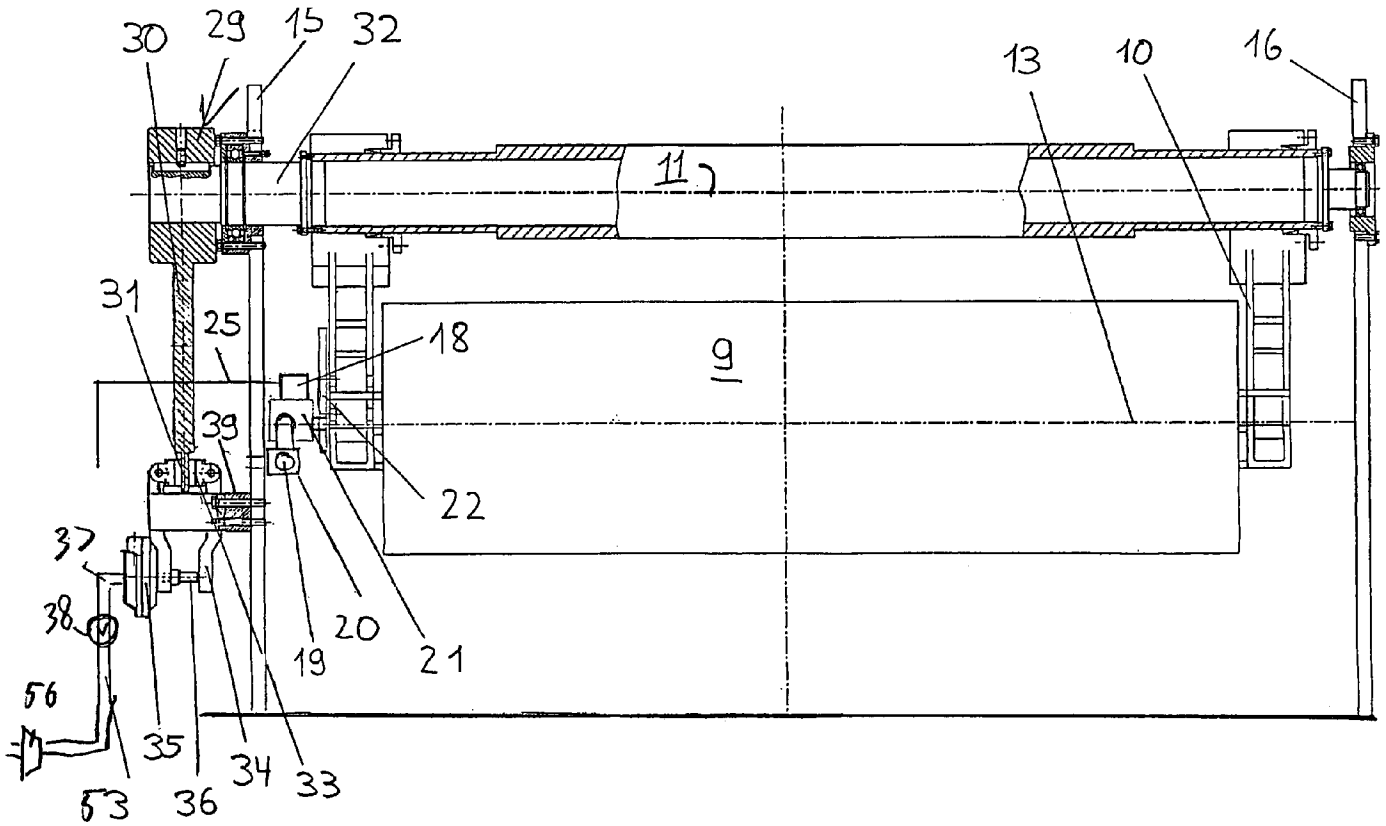
FIG. 3 is an end view of the warping system, partly in section.
Figure 4:
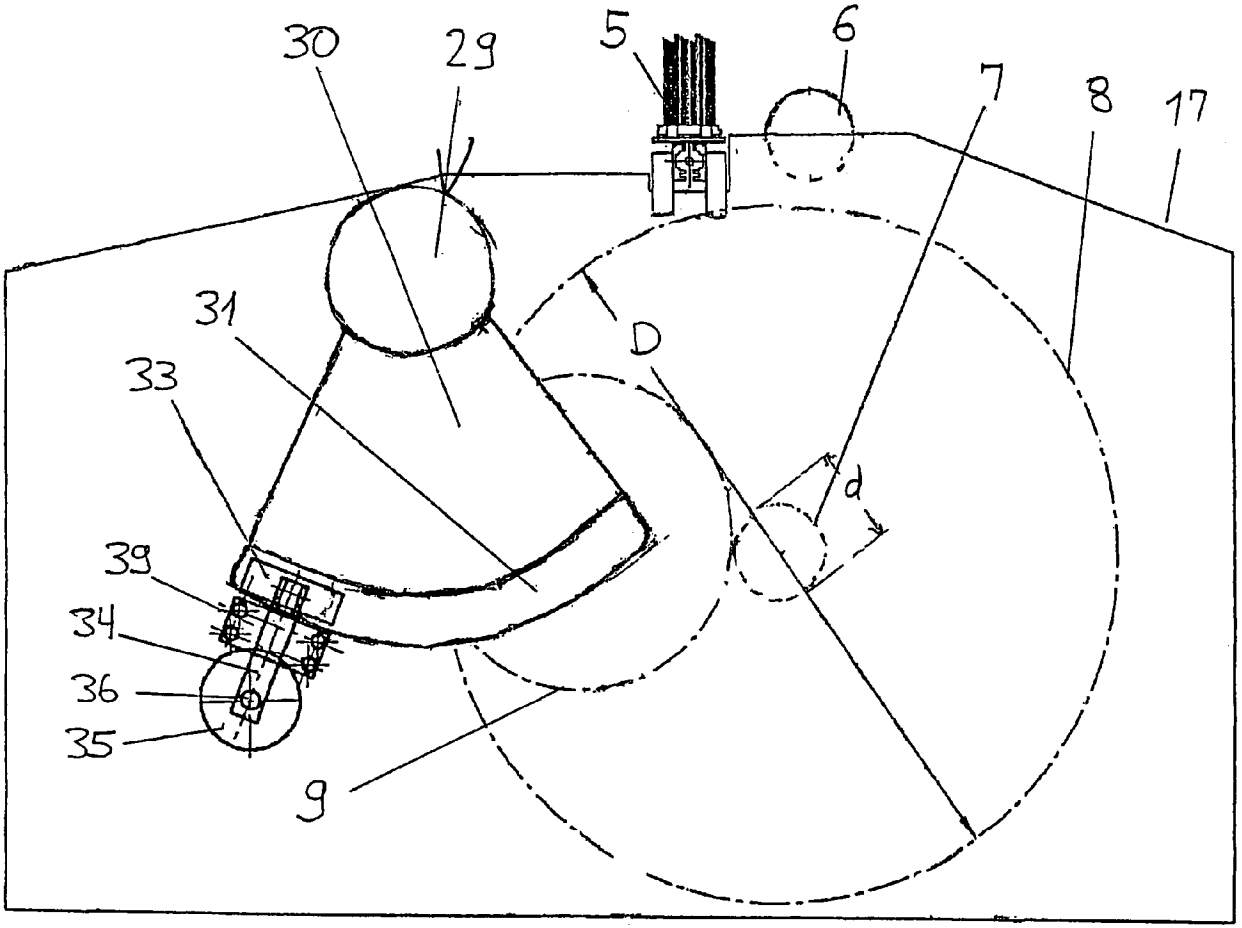
FIG. 4 is an end view of another detail of the warping system.
Figure 5:
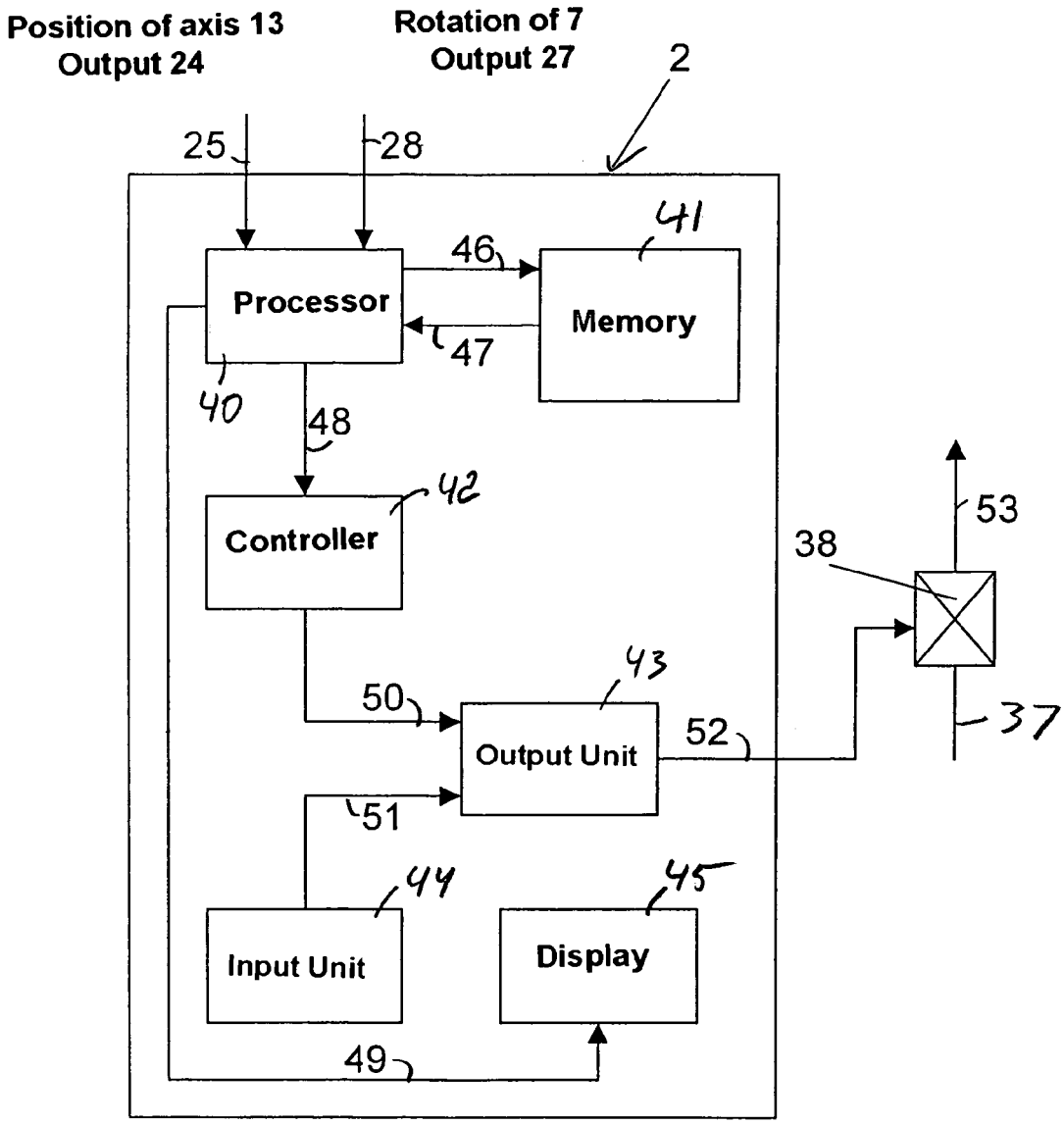
FIG. 5 is a diagram illustrating the elements for carrying out the control method of the present invention.

As also shown in FIGS. 2 and 3 the roller 9 carries a rotary transponder 18 having a gear meshing with a rack bar 19 pivoted on the frame plate 15 at an axis 20 parallel to the axes 11 and 12 and slidable in a block 21 pivoted at 22 at the axis 13 of the roller 9 and carrying the transponder 18. Thus, as the roller 9 moves in the arc 14 between its end positions, the transducer 18 will emit on a line 25 a series of pulses constituting an output shown at 24 that indicates the position of the axis 13 along the arc 14 relative to the axis 12. The axis 20 is positioned in the plane P and so is the rack 19 in the two end positions of the roller 9. When at its maximum deflected position in a half-way position, the rack 19 extends along a line 23 defining a very small acute angle with the plane P.

FIG. 1 also schematically illustrates that another such transponder or sensor 26 is provided at the axis 12 to produce in a line 28 an output 27 that represents the angular position or rotation (and possibly also the rotation direction) of the beam 7. Thus the revolutions U are represented by the output 27 and the radius r by the output 24.

FIGS. 3 and 4 show how a shaft 32 carrying the two arms 10 and journaled in the plates 15 and 16 is attached at one end to a brake 29. More particularly, this shaft 32 carries at one end a hub 29 from which extends a 60° sector plate 30 having an edge 31 engaged by a pair of brake shoes 33 both pivoted on a mount 39 carried on the plate 15 and having outer ends 34 that can be urged apart by a stem 36 of a pneumatic actuator 35 supplied via a conduit 37 from a pressure-regulating valve 38 in turn supplied via a conduit 53 with air under pressure from a source illustrated schematically at 56. Thus as pressure in the actuator 35 increases, the jaws 33 grip the plate 30 more aggressively and more forcibly brake rotation of the shaft 32 and angular displacement of the roller 9. Since as the beam 7 rotates and winds up the warp 11, the radius r has to increase, such braking action has the effect of compacting the layers or laps of warp on the beam 7.

An actuator shown schematically at 57 in FIG. 1 is provided for moving the roller 9 into the innermost position at the start of a winding cycle and for canceling out the weight of the roller 9. In addition a magnetic brake 58 is provided for impeding rotation of the roller 9.

FIG. 4 shows an SPS control assembly 2 having a microprocessor 40 with a pair of inputs receiving the outputs 24 and 27 respectively corresponding to the position of the axis 13 relative to the axis 12 and the rotation of the beam 7. A memory 41 has an input 46 for receiving data from a model warp being wound and an output 47 for feeding out this data as a set point to the processor 40 for comparison with the respective actual-data inputs 24 and 27 of subsequent copy warps.

The processor 40 has an output line 48 connected to a controller 42 whose output line 50 is fed to an output unit 43 also receiving on an input 51 data from an input unit 44, e.g. a keyboard. Another output line 49 from the processor 40 leads to a display 45 that shows the machine operator the status of the system. An output 52 from the output unit is connected to the valve 38. Converters are provided where necessary to adapt the various signals.

The function of the control assembly 2 is to control the density of the warp being wound and determine the rectified length of its filaments. To start with a model wound warp is created by securing the free ends of the warp to an empty warp beam 7 and then pressing the roller 9 radially inward against it. The brake 29 is set by the unit 2 at a predetermined clamping pressure and the cylinder 57 is released, leaving the roller 9 bearing with a force F(x) against the warp 1 on the warp tube 7. The drive 54 is then started so that the radius r of the warp 1 being wound increases, as does a deflection x of the roller 9. As this takes place the outputs 25 and 27 are stored in the memory 41. The operation continues until r=D/2, whereupon the warp 1 is cut upstream of the finished wound warp, the actuator 57 retracts the roller 9, the beam 7 is switched for an empty one that the warp 1 is applied to, and the roller 9 is moved back inward.

In order that the second and subsequent wound warps are identical to the first model one, the actual-value signals 24 and 27 are used as set points. Thus as each subsequent warp is wound, the pressure regulated by the valve 38 is changed such that any difference between new actual-value signals and the stored set-point signals is eliminated or reduced to something nominal. More particularly, any variation is converted into a pressure differential ΔF fed to the output unit 43. This value of ΔF is compared with the current pressure F(x−1) of the force previously stored in the unit 43, and is added up, F(x)=F(x−1+ΔF and fed to the valve. In this embodiment the values 24 corresponding to the deflection x and the values 27 for the revolutions U of the beam 7 are stored as tables.

Since the memory 41 can only hold a limited number of set points, the processor 40 interpolates set points for a large number of actual values and feeds the result to the controller 42. In this manner the number of control cycles is substantially greater than the number of stored set points.

The starting value of the pressure for a model beam with new filament supplies is set at the standard force Fb plus a compensating force Fa, or $F(x_0)$=Fb+Fa. The standard force Fb and the compensating force Fa are fed by the input unit or keyboard 44 to the output unit 43. With new filament supplies at any stage the actual pressure F(x−1) used at the start is increased by Fa and then further exploited as described above.

In an example using cotton, a standard packing force of 3000 N is used, with a compensating force of 20% or 600 N. When d=150 mm and D 1400 mm, the number of revolutions is recorded each time the roller 9 shifts through 10 mm, so that 125 readings are taken.

Winding is controlled at frequent intervals. Regulation starts when in a control interval there is a minimal deviation of the actual value, here the number of revolutions U of the beam 7, for a given deflection x of the roller 9. On such deviation, the set point, here the packing force, is increased or lowered by a constant amount $\Delta F_0$. The control interval here is 3 s, the minimum deviation in number of revolutions is 5 revolutions, and the standard correction $\Delta F_0$ is 0.5% of the standard force Fb, here 15 N. This value is fed as a voltage signal between 1 V and 10 V to the valve 38.

With new filament supplies instead of increasing the actual packing force F(x−1) by the compensating force Fa, a greater compensation can be effected. e.g. a multiple of $\Delta F_+$ or am amount ΔF(ΔU) proportional to the deviation from the set point, here the number of revolutions U per deflection x. This is an alternative method for compensating out smaller filament tensions with new supplies. In any case, however, the starting force has to be increased.

We claim:

1. In a method of making wound warps wherein a multiplicity of warp filaments are pulled off respective supplies and wound around a warp beam by rotating the warp beam while pressing the filaments against the beam with a predetermined packing force by a packing roller, the packing roller is deflected outward from the beam by the filaments as same are wound on the beam, an output is produced representing the rotation of the beam, an output is produced representing the rectified length of the filaments wound on the beam, and the outputs from a first wound warp are used as set points, the outputs from a subsequent wound warp are used as actual values and compared to the set points, and the force of the packing roller is varied such that the actual values of the subsequent wound warp are made generally equal to the set points the improvement wherein the output representing the rectified length is determined by generating an output corresponding to deflection of the packing roller.

2. The warp-making method defined in claim 1, further comprising the step of:

braking outward deflection of the packing roller to vary the force exerted by the packing roller on the warp being wound.

3. The warp-making method defined in claim 1, further comprising the step when the supplies are new of:

increasing the packing force by a predetermined compensating force.

4. The warp-making method defined in claim 3 wherein the compensating force is between 5% and 50% of the packing force.

5. The warp-making method defined in claim 1 wherein the packing force is adjusted for during winding of subsequent warps by using interpolated set points.

6. A method of making wound warps comprising the steps of:

producing a model wound warp by:

a) pulling a multiplicity of warp filaments off respective supplies and winding them around a first warp beam by rotating the first warp beam while pressing the filaments against the beam with a predetermined packing force by a packing roller such that the packing roller is deflected outward from the beam by the filaments as same are wound on the beam;

b) regularly producing a first-beam rotation output representing the rotation of the beam;

c) regularly producing a first-beam deflection output representing the outward deflection of the roller from the first beam; and d) recording the outputs as set points; and producing a subsequent wound warp by a) pulling a multiplicity of warp filaments off respective supplies and winding them around a second warp beam while pressing the filaments against the beam with a variable packing force by the packing roller such that the packing roller is also deflected outward from the second beam by the filaments as same are wound on the second beam;

b) regularly producing a second-beam rotation output representing the rotation of the second beam;

c) regularly producing a second-beam deflection output representing the outward deflection of the roller from the second beam; and d) comparing the second-beam outputs to the first-beam outputs; and e) varying the force with which the roller bears against the filaments on the second beam such that second-beam outputs are generally equal to the respective first-beam outputs.

7. An apparatus for making multiple wound warps, the apparatus comprising:

means for rotating a succession of warp beams;

supply means for pulling a multiplicity of warp filaments off respective supplies and wound around the warp beams;

a packing roller inwardly engageable with a packing force on the filaments on the beams, whereby the packing roller is deflected outward from the beam by the filaments as same are wound on the beam;

means for generating an output representing the rotation of the beam;

means including a sensor assembly responsive to outward deflection of the packing roller for generating an output representing the rectified length of the filaments wound on the beam;

control means comparing set points constituted by the outputs from a first wound warp with actual values constituted by the outputs from a subsequent wound warp and for varying the packing force such that the actual values of the subsequent wound warp are made generally equal to the set points.

8. The warp-winding apparatus defined in claim 7 wherein the control means includes brake means for resisting outward deflection of the packing roller and thereby varying the packing force.

9. The warp-winding apparatus defined in claim 7 wherein the sensor assembly comprises:

a rod projecting past the packing roller; and a position sensor carried on the roller, riding on the rod, and responsive to a position of the roller along the rod.

10. The warp-winding apparatus defined in claim 9 wherein the rod is pivoted at one end.

* * * * *